US009204774B1

(12) United States Patent
Jackson

(10) Patent No.: US 9,204,774 B1
(45) Date of Patent: Dec. 8, 2015

(54) ADJUSTABLE WAND FOR CLEANING APPARATUS

(71) Applicant: Craig A. Jackson, Covington, WA (US)

(72) Inventor: Craig A. Jackson, Covington, WA (US)

( * ) Notice: Subject to any disclaimer, the term of this patent is extended or adjusted under 35 U.S.C. 154(b) by 421 days.

(21) Appl. No.: 13/847,489

(22) Filed: Mar. 20, 2013

(51) Int. Cl.
*A47L 9/02* (2006.01)
*A47L 9/24* (2006.01)

(52) U.S. Cl.
CPC . *A47L 9/244* (2013.01); *A47L 9/24* (2013.01); *A47L 9/242* (2013.01); *A47L 9/248* (2013.01)

(58) Field of Classification Search
CPC ..... A47L 9/244; A47L 9/24; A47L 9/242; A47L 9/248; A47L 9/32; A47L 9/327
USPC ..... 15/414; 285/7, 33, 145.4, 322–324, 395
See application file for complete search history.

(56) References Cited

U.S. PATENT DOCUMENTS 2,123,813 A * 7/1938 Stiles ..... 15/144.4
3,083,041 A * 3/1963 Owenmark ..... 285/7
4,715,084 A * 12/1987 Jacob et al. ..... 15/328
5,586,360 A * 12/1996 Diederiks, Jr. et al. ..... 15/410
5,927,758 A * 7/1999 Carlsson ..... 285/7
6,101,673 A * 8/2000 Edin ..... 15/414
6,557,878 B2 * 5/2003 Chen ..... B62K 19/36 280/226.1
8,708,373 B2 * 4/2014 Stickney et al. ..... 285/7
2008/0014015 A1 * 1/2008 Brick ..... B62K 3/005 403/109.1
2008/0298886 A1 * 12/2008 Chen ..... B62K 19/36 403/373

FOREIGN PATENT DOCUMENTS

EP 1875849 A2 * 1/2008

* cited by examiner

*Primary Examiner* — Bryan R Muller
(74) *Attorney, Agent, or Firm* — Joseph Z. Ellsworth

(57) ABSTRACT

An embodiment of this invention is an adjustable wand for a carpet cleaning apparatus wherein the upper tube telescopes within a lower tube and allows lengthening of the wand. The lower nozzle is adjustable in that it allows rotation about the wand axis and allows removal of the nozzle. The preferred means for adjustment is a cam lock mechanism that tightens an adjustment clamp around the wand upper tube or nozzle neck.

14 Claims, 2 Drawing Sheets

ADJUSTABLE WAND FOR CLEANING APPARATUS

TECHNICAL FIELD

This invention relates to carpet cleaning devices, more specifically adjustable wands for extracting contaminates and stains from carpet.

BACKGROUND ART

Modern homes have carpets that provide insulation, sound reduction and comfort. These carpets are susceptible to staining and soil intrusion from the feet of inhabitants. Many companies have invented cleaning devices using suction to draw out dirt and soil. Other cleaning devices use wet cleaning wherein steam or detergent enriched water is sprayed on the carpet and immediately extracted by suction. These carpet cleaners have a wand that has sprayers near a nozzle end and a suction tube and are configured to be used while a person is standing. Since people are of different heights or hold the wand in different ways, it is necessary to have wands of different lengths. Also, carpet cleaners may be used over different surfaces, such as stairs, during the same job and therefore adjustability in the nozzle is needed.

Prior art wand design of Mayhew (U.S. Pat. No. 5,113,547) has a telescoping wand length and an adjustable nozzle. The wand length telescopes inside an outer sleeve and is locked in place by a locking slip nut. The locking slip nut requires multiple twists of the slip nut to compress a compression ring against the tube. This method is low profile in design but requires two hands to adjust and takes valuable time to twist the nut to unlock and lock in place. The nozzle is adjustable through an arc of 30-60 degrees but is not rotatable about the wand axis, nor is it quick-release to change nozzles.

There is a need in the art for a wand that is easily adjustable in length and can be adjusted by one hand. There is also a need in the art for an easily replaceable nozzle that also allows rotation about the tube axis.

SUMMARY

It is therefore a benefit to the art to address the shortcomings of the prior art by introducing a novel solution to the known problems. An embodiment of the present invention is a carpet cleaning wand with suction and a high pressure sprayer for cleaning carpets and tile floors. This cleaning wand has an upper tube that serves as a handle as well as a place to attach suction. The upper tube fits into a lower tube telescopically with a precision fit that prevents loss of suction at the joint. The tubes are held in place by a cam locking adjustment clamp which clamps tightly applying a friction force on the tube to prevent relative movement. The adjustment clamp has a cam lock feature that uses leverage to transform small forces on the cam lock handle into larger forces at the cam lock variable radius. These forces could damage the thin walled upper and lower tubes and therefore, it is advantageous to spread out the forces around the tubes by using a cam lock adjustment clamp. The cam lock does not press directly against the thin walled tubes but presses against the upper tabs on the adjustment clamp and as the tabs move together a constant force is spread around the upper tube. The adjustment clamp has a permanent bolt through the lower tabs attaching the clamp to the lower suction tube.

Another embodiment of the invention is a lower handle attached semi-permanently to the upper suction tube. This allows the adjustment of the wand length to not affect the distance between the lower handle and the bend in the upper suction tube used as an upper handle. A handle grip material is disposed over the upper suction tube to create a comfortable area for the user hand. This distance between the upper and lower handles can be set by the user to the most comfortable position and is not changed when the wand length is adjusted. This attribute is of remarkable effect when the user is cleaning stairs. The wand must be shortened or lengthened to reach stairs going up or down respectively. The user will still desire that the distance between hands remains the same and the nozzle moves to meet the surface to be cleaned.

Another embodiment of the invention is a quick releasable nozzle. The lower tube may have a second cam lock adjustment clamp situated to receive various nozzles. The nozzles have a suction nozzle neck that is received telescopically into the lower suction tube and held in place by the lower cam lock adjustment clamp. This feature allows for facile changes in nozzles for edges of the room or for tile. The lower cam lock adjustment clamp also allows the nozzle to be rotated about the lower tube axis to clean the risers on stairs or for other reasons.

Another embodiment of the invention is one handed actuation of the locking mechanism. With one user hand still on the upper suction tube, the other user hand can easily actuate the cam lock feature, adjust the wand length and lock the cam lock feature again. This aspect is very important due to carpet cleaning being priced by the job and not by the time taken to complete the job. Any enhancement to efficiency is money in the user's pocket.

DETAILED DESCRIPTION OF THE PREFERRED EMBODIMENT

Figure 1:
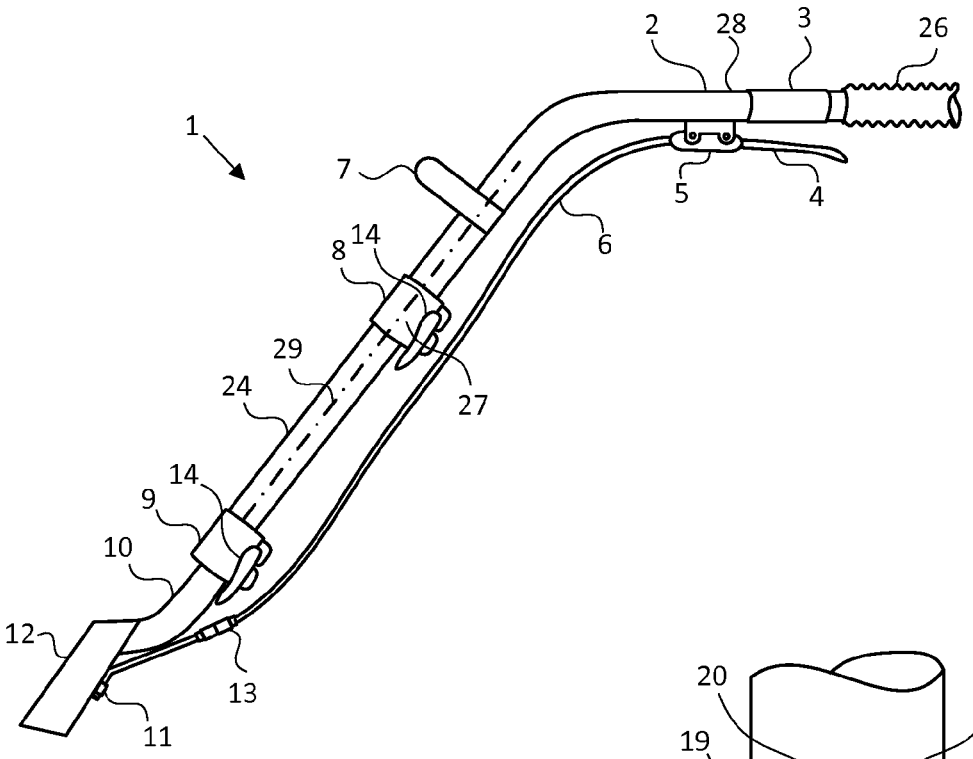
FIG. 1. A perspective view of an embodiment of the adjustable wand showing the adjustable wand in a preferred orientation.

A preferred embodiment of the present invention is a carpet cleaning wand 1 with an upper suction tube 2 that serves as a handle to hold as well as a place to attach suction 26. The upper suction tube 2 fits into a lower suction tube 24 telescopically with a precision fit that prevents loss of suction at the joint 27. The tubes 2, 24 are held in place by an adjustment clamp 14 which clamps tightly; applying a friction force on the upper suction tube 2 to prevent relative movement. The upper and lower adjustment clamps 8, 9 have a cam lock 15 comprising a cam lock handle 16 and a cam lock variable radius 18. To prevent damage to the thin walled tubes 2, 24, used in making upper and lower tubes, it is advantageous to spread out the forces around the tubes by using a cam lock adjustment clamp 14. The cam lock 15 does not press directly against the thin walled tubes 2, 24 but presses against a rotation washer 19 which is contacts the upper tabs 20 on the adjustment clamp 14 and as the tabs 20 move together a constant force is spread around the upper tube 2. The adjustment clamp 14 has a fastener 22 through the lower tabs 23 attaching the adjustment clamp 14 to the lower suction tube 24.

A lower handle 7 is attached semi-permanently to the upper suction tube 2. This allows the adjustment of the wand 1 length to not affect the distance between the lower handle 7 and the bend in the upper suction tube 2 used as the upper handle 28. A handle grip material 3 is disposed over the upper suction tube 2 to create a comfortable area for the user hand. This distance between the upper and lower handles 7, 28 can be set by the user to the most comfortable position and the distance is not changed when the wand 1 length is adjusted.

Another embodiment of the invention is a quick releasable suction nozzle 12. The lower tube 24 may have a lower adjustment clamp 9 situated to receive various nozzles 12. The nozzles have a suction nozzle neck 10 that is received telescopically into the lower suction tube 24 and held in place by the lower adjustment clamp 9. The lower adjustment clamp 9 also allows the nozzle 12 to be rotated about the lower tube axis 29 to clean the risers 102 on stairs 101 or for other reasons.

Another embodiment of the invention is the ability to actuate the cam lock adjustment clamp 14 with one user hand 31. With one user hand 30 still on the upper suction tube 2, the lower user hand 31 can easily actuate the cam lock 15, adjust the wand 1 length and lock the cam lock 15 again.

Referring to FIG. 1, the cleaning wand 1 was a suction hose 26 attached to the upper suction tube 2 for drawing water and dirt out of carpets. The upper suction tube 2 has a handle grip material 3 for comfort to the user during use. The upper suction tube 2 may also be bent to create an upper handle 28 for a more ergonomic use. A trigger bracket 5 is preferably welded to the upper suction tube 2 from which a sprayer trigger 4 is attached. The sprayer trigger 4 releases a high pressure spray through sprayer hose 6 and exits from spray nozzle 11. The spray nozzle 11 is attached to the suction nozzle 12. The high pressure sprayer hose 6 terminates at a sprayer hose disconnect 13 to allow different nozzles 12 to be detached and re-attached. Suction nozzle 12 has an elongate portion forming a suction nozzle neck 10 which is bent to slide telescopically into lower suction tube 24 and also maintain the appropriate angle to the cleaning surface.

Figure 2:
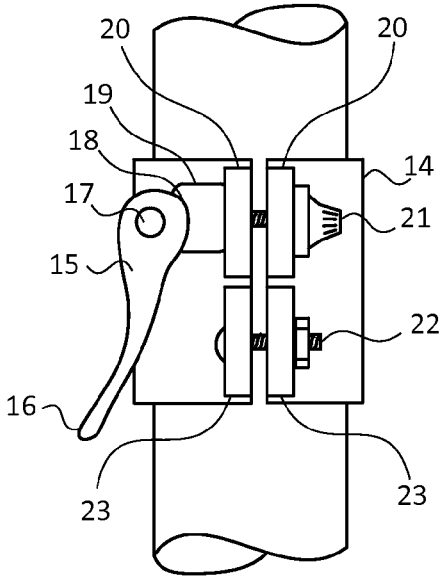
FIG. 2. A close up view of an example cam lock adjustment clamp.

Referring to FIG. 2, the adjustment clamp 14 has upper tabs 20 and lower tabs 23. The lower tabs 23 have a fastener 22 or equivalent fastener to tighten the adjustment clamp 14 around the lower suction tube 24. The upper tabs 20 are tightened using a cam lock 15 which rotates about a cam lock axis 17. As the handle 16 is urged downward the rotation of the variable radius 18 about the cam lock axis 17 creates a large force on the rotation washer 19. The rotation washer 19 is urged toward the cam lock nut 21 which pinches the upper tabs 20 together tightening on the upper tube 2 and restricting any rotational or linear motion. The preferred embodiment is the cam lock adjustment clamp 14 but the adjustment clamp 14 could be tightened by twisting a handle, or other mechanical advantage clamping means.

Figure 3:
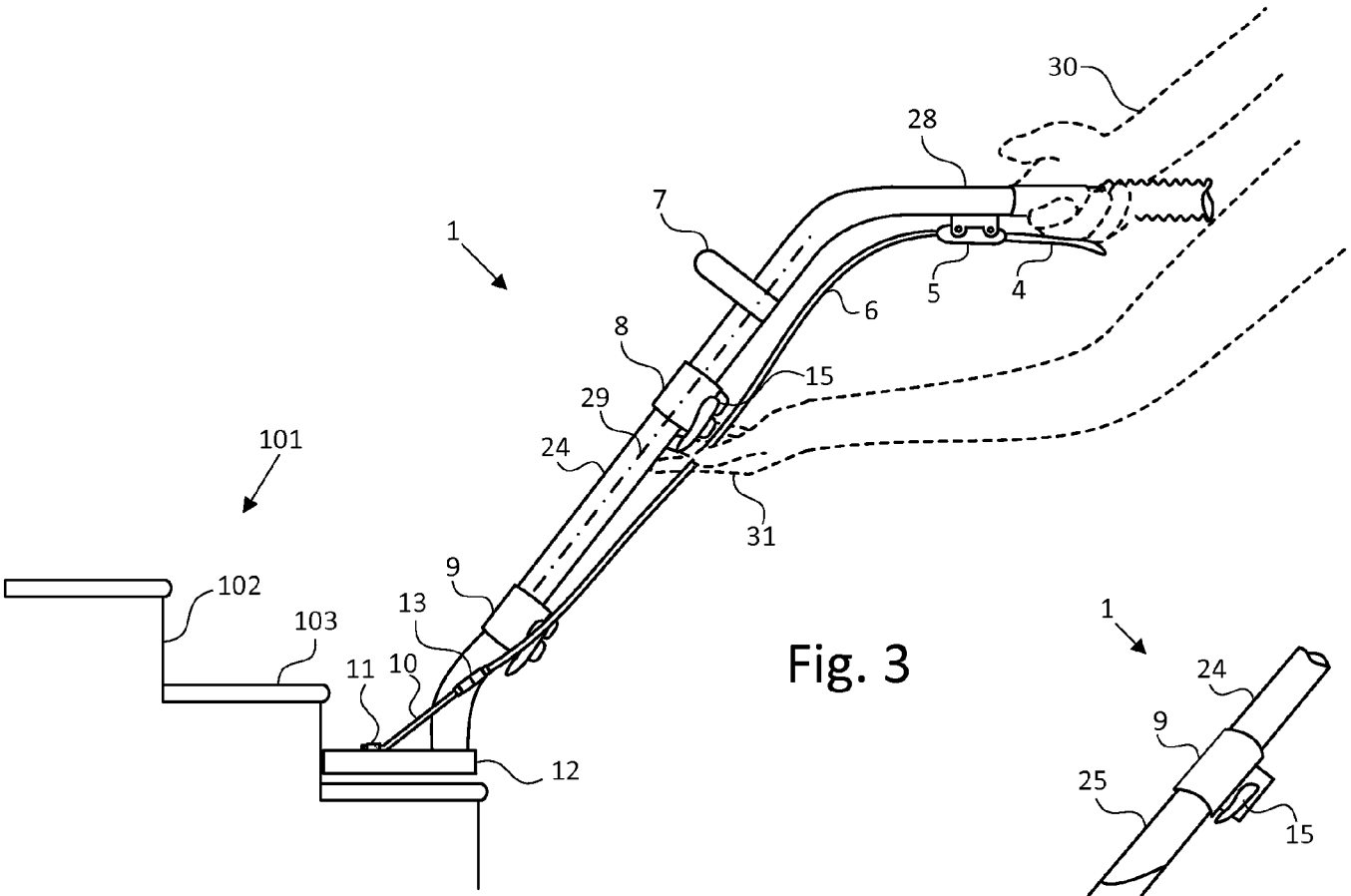
FIG. 3. A perspective view of an embodiment of the adjustable wand in an orientation for cleaning stair risers.

Referring to FIG. 3, the cleaning wand 1 is shown being used in a situation where multiple and frequent adjustments are made to the wand 1 length and nozzle 12 orientation. The nozzle 12 is rotated about the lower suction tube axis 29 to allow more facile cleaning of the stair riser 102. The nozzle 12 can then be rotated back to clean the stair tread 103 and the wand 1 length can then be shortened to accommodate a user being a few steps down from the stair 101 being cleaned. The user upper hand 30 is shown on the upper handle 28 while at the same time the user's lower hand 31 is adjusting the cam lock 15.

Figure 4:
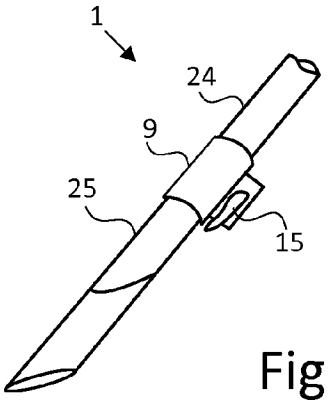
FIG. 4. A perspective view of the lower portion of the wand with an example edge cleaning tool.

Referring to FIG. 4, a cleaning wand 1 is shown with an edge cleaning nozzle 25 for getting in hard to reach areas. The edge cleaning nozzle 25 is quickly and telescopically attached to the lower suction tube 24 and held in place by the lower adjustment clamp 9.

The upper and lower suction tubes 2, 24 have wall thickness of between 0.010 inch and 0.063 inch stainless steel but preferably 0.049 inches. To save weight and to increase buckling strength the wand may be made from another material such as titanium, beryllium, magnesium or aluminum which allows the wall thickness to be increased. Preferably, the upper tube 2 length is forty one inches and the lower tube 24 is nineteen inches. This gives the wand 1 a total adjustment distance of seventeen inches. The upper handle 28 is made by bending the upper tube 2 to an angle of between 110 degrees to 155 degrees. The upper tube 2 interior diameter is preferably 1.5 inches and the lower tube 24 is preferably 1.625 inches. Adjusting the material thickness of the upper tube 2, a gap of 0.001 to 0.010 inches is maintained between the upper and lower tube 2, 24 when the upper tube 2 telescopes within the lower tube 24.

Another embodiment of the invention is a method for using the cleaning wand 1 comprising the steps of adjusting the distance between an upper and lower handle 28, 7 to a user preferred distance, adjusting the wand length by sliding an upper suction tube 2 telescopically within a lower suction tube 24 with a precision fit that prevents loss of suction. Then locking the upper and lower suction tubes 2, 24 in place with an adjustment clamp 8, wherein, the adjustment clamp 8 comprises a cam lock 15 further comprising a cam lock handle 16 and a cam lock variable radius 18, a rotation washer 19 and a cam lock nut 21. The adjustment clamp 8 further comprises upper and lower tabs 20, 23; the lower tabs 23 being tightened by a bolt 22 and tightened about the lower suction tube 24, and the upper tabs 20 are tightened about the upper suction tubes 2 by the cam lock 15. Also, a person may adjust a suction nozzle 12 by means of a lower adjustment clamp 9 configured to receive a suction nozzle neck 10 telescopically into the lower suction tube 24 and held in place by the lower adjustment clamp 9 wherein, the lower adjustment clamp 9 allows a nozzle 12 to be rotated about a lower tube axis 29 wherein, the lower adjustment clamp 9 further allows facile nozzle 12 replacement. Also, a person may actuate both adjustment clamps 8, 9 using one user hand and this allows continuous use of the wand while cleaning a carpet under furniture or on stairs 101. The nozzle 12 may also be rotated one hundred and eighty degrees about the lower suction tube axis 29 to allow cleaning of a stair riser 102. Also, the nozzle 12 may be changed to an edging tool nozzle 25 or a tile grout cleaning nozzle or a hard surface nozzle.

I claim:

1. An adjustable carpet cleaning wand comprising, an upper suction tube configured to serve as a handle, the upper suction tube telescopically fits into a lower suction tube with a precision fit that prevents loss of suction wherein, the upper and lower suction tubes are held in place by an adjustment clamp, a lower handle is slidably attached to the upper suction tube, wherein the upper suction tube comprises a bend wherein, the adjustment clamp comprises a cam lock further comprising a cam lock handle and a cam lock variable radius, a rotation washer and a cam lock nut, wherein the adjustment clamp further comprises upper and lower tabs, the lower tabs being tightened by a bolt and tightened about the lower suction tube, the upper tabs are tightened about the upper suction tubes by the cam lock.

2. The adjustable wand of claim 1, wherein, a handle grip material is disposed over the upper suction tube.

3. The adjustable wand of claim 1, wherein, the lower suction tube comprises a lower adjustment clamp configured to receive a suction nozzle neck telescopically into the lower suction tube and is held in place by the lower adjustment clamp wherein, the lower adjustment clamp allows a nozzle to be rotated about a lower tube axis wherein, the lower adjustment clamp further allows facile nozzle replacement.

4. The adjustable wand of claim 1 wherein the upper tube outer diameter and lower tube inner diameter differ by between one thousandth of an inch to ten thousandths of an inch.

5. The adjustable wand of claim 1 wherein the upper and lower suction tubes have wall thickness' of between 0.010 inch and 0.063 inch stainless steel.

6. The adjustable wand of claim 1 wherein the bend in the upper handle forms an angle of between 110 degrees to 155 degrees.

7. The adjustable wand of claim 1 wherein the upper tube diameter is 1.5 inches.

8. A method for using a cleaning wand comprising the steps of, adjusting the distance between and upper and lower handle to a user preferred distance, adjusting the wand length by sliding an upper suction tube telescopically within a lower suction tube with a precision fit that prevents loss of suction, locking the upper and lower suction tubes in place with an adjustment clamp, wherein, the cam locking adjustment clamp comprises a cam lock further comprising a cam lock handle and a cam lock variable radius, a rotation washer and a cam lock nut, the cam locking adjustment clamp further comprises upper and lower tabs, the lower tabs being tightened by a bolt and tightened about the lower suction tube, the upper tabs are tightened about the upper suction tubes by the cam lock, adjusting a suction nozzle by utilizing a lower adjustment clamp configured to receive a suction nozzle neck telescopically into the lower suction tube and held in place by the lower cam lock adjustment clamp wherein, the lower cam lock adjustment clamp allows a nozzle to be rotated about a lower tube axis wherein, the lower adjustment clamp further allows facile nozzle replacement, actuating the adjustment clamp with one user hand.

9. The method of claim 8 further comprising the step of, rotating the nozzle one hundred and eighty (180) degrees to allow cleaning of a stair riser.

10. The method of claim 8 further comprising the step of, changing the nozzle to an edging tool or grout cleaning tool or hard surface tool.

11. An adjustable carpet cleaning wand comprising, an upper suction tube that serves as a handle, the upper suction tube telescopically fits into a lower suction tube with a precision fit that prevents loss of suction wherein, the upper and lower suction tubes are held in place by a cam locking adjustment clamp, wherein, the cam locking adjustment clamp comprises a cam lock further comprising a cam lock handle and a cam lock variable radius, a rotation washer and a cam lock nut, the cam locking adjustment clamp further comprises upper and lower tabs, the lower tabs being tightened by a bolt and tightened about the lower suction tube, the upper tabs are tightened about the upper suction tubes by the cam lock, a lower handle is slidably attached to the upper suction tube, allowing adjustment of the overall wand length to not affect the distance between the lower handle and a bend in the upper suction tube used as an upper handle wherein, a handle grip material is disposed over the upper suction tube, the lower suction tube comprises a lower cam lock adjustment clamp configured to receive a suction nozzle neck telescopically into the lower suction tube and held in place by the lower cam lock adjustment clamp wherein, the lower cam lock adjustment clamp allows a nozzle to be rotated about a lower tube axis wherein, the lower adjustment clamp further allows facile nozzle replacement.

12. The wand of claim 11 wherein, the upper and lower handles are configured to remain fixed when the wand length is adjusted.

13. The wand of claim 11 wherein, the cam lock adjustment clamp is configured to spread the forces around the tubes to prevent damage.

14. The wand of claim 11 wherein the nozzle is one of an edging tool nozzle, a tile grout cleaning nozzle or a hard surface nozzle.

* * * * *